US010906674B2

(12) United States Patent
Cho et al.

(10) Patent No.: US 10,906,674 B2
(45) Date of Patent: Feb. 2, 2021

(54) METHOD FOR REVERSE-FILLING COSMETIC MATERIAL HAVING IRREVERSIBLE PROPERTY AND COSMETIC CONTAINER FILLED THEREWITH

(71) Applicant: COSMECCA KOREA CO., LTD., Chungcheongbuk-do (KR)

(72) Inventors: Hyun Dae Cho, Chungcheongbuk-do (KR); Hyoun Cheol An, Chungcheongbuk-do (KR); Eun Ji Kim, Gyeonggi-do (KR); Jin Kyu Sun, Seoul (KR); Bong Jun Kim, Gyeonggi-do (KR)

(73) Assignee: COSMECCA KOREA CO., LTD., Chungcheongbuk-Do (KR)

( * ) Notice: Subject to any disclaimer, the term of this patent is extended or adjusted under 35 U.S.C. 154(b) by 0 days.

(21) Appl. No.: 16/061,722

(22) PCT Filed: May 27, 2016

(86) PCT No.: PCT/KR2016/005651

§ 371 (c)(1),
(2) Date: Jun. 13, 2018

(87) PCT Pub. No.: WO2017/104918

PCT Pub. Date: Jun. 22, 2017

(65) Prior Publication Data

US 2018/0362196 A1 Dec. 20, 2018

(30) Foreign Application Priority Data

Dec. 18, 2015 (KR) ..... 10-2015-0182132

(51) Int. Cl.
*B65B 3/32* (2006.01)
*B65B 29/00* (2006.01)
(Continued)

(52) U.S. Cl.
CPC ..... *B65B 3/32* (2013.01); *A45D 40/00* (2013.01); *B65B 3/00* (2013.01); *B65B 25/00* (2013.01);
(Continued)

(58) Field of Classification Search
CPC ..... B65B 3/32; B65B 35/58; B65B 43/54; B65B 29/00; B65B 3/00; B65B 63/08;
(Continued)

(56) References Cited

U.S. PATENT DOCUMENTS 1,872,864 A * 8/1932 Yarcho ..... A45D 40/00 206/430
4,621,935 A * 11/1986 Sussman ..... A45D 40/02 220/200
(Continued)

FOREIGN PATENT DOCUMENTS

FR 2956833 A1 * 9/2011 ..... A45D 40/00
JP H-0937839 A * 2/2005
(Continued)

OTHER PUBLICATIONS

"Agar and Plate Preparation." Doane University, 2013 [retrieved on Sep. 12, 2019. Retrieved from the Internet URL: https://www.doane.edu/agar-and-plate-preparation] (Year: 2013) (Year: 2013).*
(Continued)

*Primary Examiner* — Marina A Tietjen
*Assistant Examiner* — Stephanie A Shrieves
(74) *Attorney, Agent, or Firm* — Bacon & Thomas, PLLC

(57) ABSTRACT

A method for reverse-filling cosmetic material having an irreversible property and a cosmetic container filled therewith, including the steps of: sealing the top part of the cosmetic inner container, the top and bottom of which are open, with a filling mold, and turning the cosmetic inner container upside down to reverse-position the cosmetic inner
(Continued)

(a)

(b)

container so that the sealed top part of the cosmetic inner container is directed downward and the open bottom part thereof is directed upward; and filling the cosmetic inner container through the bottom part thereof with the cosmetic material. In so doing, the top surface of the cosmetic material filled in the cosmetic container is smooth without any bumps, moisture seepage phenomenon is prevented, and cosmetic material having excellent applicability can be provided as the hardness thereof is relatively low by reverse-filling the cosmetic container with cosmetic material having an irreversible property, such as agar.

12 Claims, 6 Drawing Sheets

(51) Int. Cl.

| | |
|---|---|
| ***B65D 81/28*** | (2006.01) |
| ***A45D 40/00*** | (2006.01) |
| ***B65D 25/00*** | (2006.01) |
| ***B65B 63/08*** | (2006.01) |
| ***B65D 43/16*** | (2006.01) |
| ***B65B 25/00*** | (2006.01) |
| ***B65D 77/04*** | (2006.01) |
| ***B65D 81/26*** | (2006.01) |
| ***B65B 3/00*** | (2006.01) |
| *A45D 40/22* | (2006.01) |
| *B65B 35/58* | (2006.01) |
| *B65B 43/54* | (2006.01) |

(52) U.S. Cl.
CPC ..... *B65B 29/00* (2013.01); *B65B 63/08* (2013.01); *B65D 25/00* (2013.01); *B65D 43/16* (2013.01); *B65D 77/04* (2013.01); *B65D 81/26* (2013.01); *B65D 81/28* (2013.01); *A45D 40/22* (2013.01); *B65B 35/58* (2013.01); *B65B 43/54* (2013.01)

(58) Field of Classification Search
CPC ..... B65B 25/00; B65B 3/04; B05B 11/00446; B05B 11/0097; B05B 11/0005; A45D 40/22; A45D 40/00; B65D 43/16; B65D 81/28; B65D 81/26; B65D 77/04; B65D 25/00; B67C 3/26; B67C 3/2604
USPC ..... 141/1, 2, 5, 113
See application file for complete search history.

(56) References Cited

U.S. PATENT DOCUMENTS

| | | | | |
|---|---|---|---|---|
| 7,314,051 | B2 * | 1/2008 | Yuhara | A45D 33/006 132/294 |
| 2006/0210517 | A1 * | 9/2006 | Mower | A61K 8/9711 424/70.13 |
| 2009/0041698 | A1 * | 2/2009 | Cabiling | A61K 8/02 424/69 |
| 2014/0014659 | A1 * | 1/2014 | Thorpe | A45C 13/008 220/291 |
| 2014/0326273 | A1 * | 11/2014 | Kalyanpur | A45D 40/24 132/314 |

FOREIGN PATENT DOCUMENTS

| | | | | | |
|---|---|---|---|---|---|
| JP | H0937839 | A | * | 2/2005 | |
| JP | 2009082162 | A | * | 4/2009 | |
| JP | 2013085751 | A | * | 5/2013 | |
| JP | 5598793 | B2 | * | 10/2014 | |
| KR | 920005639 | B1 | * | 7/1992 | |
| KR | 10-0817278 | Y1 | | 3/2008 | |
| KR | 10-2010-0059520 | | | 6/2010 | |
| KR | 101058201 | B1 | * | 8/2011 | |
| KR | 10-2013-0048518 | B1 | | 5/2013 | |
| KR | 20130048518 | A | * | 5/2013 | |
| KR | 10-2014-0074541 | A | | 6/2014 | |
| KR | 20140074541 | A | * | 6/2014 | |
| KR | 10-1423553 | B1 | | 8/2014 | |
| KR | 10-2015-0107224 | Y1 | | 9/2015 | |
| KR | 101566803 | B1 | * | 11/2015 | A45D 40/22 |
| WO | WO-2014005265 | A1 | * | 1/2014 | A45D 40/24 |
| WO | WO-2015038871 | A1 | * | 3/2015 | A45D 33/00 |

OTHER PUBLICATIONS

KR-10158201-B1 English Translation of Specification (Year: 2011).*
FR-2956833-A1 English Translation of Specification (Year: 2011).*
HPH-0937839-A English Translation of Specification (Year: 2005).*
KR-101566803-B1 English Translation of Specification (Year: 2015).*
KR-920005639-B1 English Translation of Specification (Year: 1992).*
KR-20130048518-A English Translation of Specification (Year: 2013).*
International Search Report in PCT/KR2016/005651, dated Sep. 12, 2016.

* cited by examiner

METHOD FOR REVERSE-FILLING COSMETIC MATERIAL HAVING IRREVERSIBLE PROPERTY AND COSMETIC CONTAINER FILLED THEREWITH

FIELD OF THE INVENTION

The present invention relates to a method for reverse-filling cosmetic material having irreversible property and a cosmetic container filled therewith and, more particularly, to a method for reverse-filling cosmetic material having irreversible property and a cosmetic container filled therewith, the method comprising reverse-filling the cosmetic container with cosmetic material having an irreversible property such as agar from a direction of a bottom part of the cosmetic container such that the surface of the cosmetic material filled in the cosmetic container is smooth without any bumps, moisture seepage phenomenon is prevented, and cosmetic material having excellent applicability can be provided as the hardness thereof is relatively low.

BACKGROUND OF THE INVENTION

Agar used in the present invention, as agar which is produced by performing freezing dehydration and drying processes of mucus that belongs to Gelidium amansii or the same classification thereof or is obtained from different types of red algae, is a translucent body having colors ranging from white color to light yellow white color. Such agar absorbs water within intestines to have characteristics that volume of agar is swollen by itself, and is a kind of intercellular viscous polysaccharides having galactose as a main component and including a sulfuric acid group.

Further, an agar solution has excellent solidification power, and a solidified agar solution has a relatively high melting point and is not easily spoiled, and has a high ability of retaining water in a predetermined shape. Therefore, the agar solution not only is commonly used in processing of food such as jelly, jam or the like, but also is used as material for industrial films.

Particularly, since agar is low in calories, agar is spotlighted as a diet food, is widely used in food fields such as fermented food, and has recently been commonly used in cosmetic material.

However, cosmetic material using agar has problems that a pearl band is seen from the surface of a filling-completed cosmetic material, a surface state of the cosmetic material is not even, and pay-off is also not easy when selecting a method of forward-filling the cosmetic container with the cosmetic material from the top part of the cosmetic container by a general cosmetic material filling method due to irreversible property of agar in temperature changes at which agar becomes a sol or a gel.

Although it is disclosed in Korean Patent Publication No. 10-2014-0074541 that a step of solidifying a cosmetic composition containing agar comprises attaching a sheet to the surface of the composition to solidify the sheet attached to the surface of the composition, and removing the sheet, thereby removing along with removal of the sheet a thin film formed by agar on the surface of the composition brought into contact with air in the solidification step to solve a problem that application power is remarkably reduced, there is a disadvantage that the surface of the solidified cosmetic material of Korean Patent Publication No. 10-2014-0074541 still does not have an even flatness due to a process of removing a thin film formed by indispensable agar.

Therefore, the present applicant has continuously studied to solve the above-mentioned problems. As a result, the present applicant has developed a reverse-filling method and a container suitable therefor as in the present invention.

PRIOR ART DOCUMENT

Patent Document

Korean Patent Publication No. 10-2014-0074541

SUMMARY OF THE INVENTION

The present invention provides a method for reverse-filling cosmetic material, the method comprising reverse-filling the cosmetic container with cosmetic material having an irreversible property such as agar from a direction of a bottom part of the cosmetic container such that the surface of the cosmetic material filled in the cosmetic container is smooth without any bumps, moisture seepage phenomenon is prevented, and cosmetic material having excellent applicability can be provided as the hardness thereof is relatively low.

The present invention also provides a cosmetic container filled with the cosmetic material having an irreversible property such as agar.

In an aspect, a method for filling a cosmetic inner container with cosmetic material having an irreversible property is provided. The method comprises the steps of:

sealing the top part of the cosmetic inner container, the top and bottom of which are open, with a filling mold, and turning the cosmetic inner container upside down to reverse-position the cosmetic inner container so that the sealed top part of the cosmetic inner container is directed downward and the open bottom part thereof is directed upward; and filling the cosmetic inner container through the bottom part thereof with the cosmetic material.

Further, the method for reverse-filling the cosmetic material having irreversible property according to the present invention further comprises, after the step of filling the cosmetic material, a step of cooling the filled cosmetic material to solidify the cosmetic material.

Further, in the method for reverse-filling the cosmetic material having irreversible property according to the present invention, the cosmetic material is characterized in that it is cooled at a temperature of −20 to 4° C. for 3 to 10 minutes and solidified at room temperature for 10 to 30 minutes.

Further, in the method for reverse-filling the cosmetic material having irreversible property according to the present invention, In the step of solidifying the cosmetic material, water oozes out from the cosmetic material in an amount of 0.001 to 0.02 g (wt %) based on the total weight of the cosmetic material.

Further, the method for reverse-filling the cosmetic material having irreversible property according to the present invention additionally includes, after the step of solidifying the cosmetic material, a step of coupling a lower stopper to the bottom part of the cosmetic inner container, forward-positioning the cosmetic inner container such that the bottom part of the cosmetic inner container is directed downward, and removing a filling mold sealed on the top part of the cosmetic inner container.

Further, in the method for reverse-filling the cosmetic material having irreversible property according to the present invention, the filling mold is characterized in that it is a member having a shape that the bottom surface of the filling mold is fitted to the top part of the cosmetic inner container, or sealing paper that seals the top part of the cosmetic inner container.

Further, in the method for reverse-filling the cosmetic material having irreversible property according to the present invention, the bottom surface of the member and the bottom surface of the sealing paper have a pattern formed in an embossing or engraving design thereon.

Further, in the method for reverse-filling the cosmetic material having irreversible property according to the present invention, a pattern of the bottom surface of the filling mold is transferred onto the top surface of the cosmetic material filled in the cosmetic inner container such that the pattern is formed in an engraving or embossing design.

Further, in the method for reverse-filling the cosmetic material having irreversible property according to the present invention, the top surface of the cosmetic material filled in the cosmetic inner container has a maximum surface step of 0.1 to 0.4 mm In another aspect, a method for reverse-filling the cosmetic material having irreversible property according to the present invention is provided, the method comprises the steps of:

preparing the cosmetic material having irreversible property;

preparing a cosmetic container into which the cosmetic material is injected;

coupling a filling mold 30 to the top part of a cosmetic inner container 20, the top and bottom of which are open, in the cosmetic container;

reverse-positioning the cosmetic inner container 20 and reverse-filling the cosmetic inner container 20 with the cosmetic material 2 from the open bottom part of the cosmetic inner container;

solidifying the cosmetic material 2; and coupling a bottom stopper and a cover of the cosmetic inner container 20.

Further, in the method for reverse-filling the cosmetic material having irreversible property according to the present invention, the cosmetic material having irreversible property filled in the cosmetic inner container is prepared by dissolving and dispersing a water-soluble component of the cosmetic material at 30 to 80° C., completely dissolving agar at 50 to 90° C., and mixing and dispersing the completely dissolved agar with the water-soluble component to prepare a dispersion, mixing an oil-soluble component of the cosmetic material with the dispersion, emulsifying and dispersing a mixed solution of the oil-soluble component and the dispersion by a mixing stirrer at 30 to 85° C. for 3 to 10 minutes, and deaerating the emulsified and dispersed solution for about 5 to 10 minutes, and then injecting the emulsified and dispersed solution into a vessel which is maintained at a predetermined temperature, stirring the emulsified and dispersed solution by the mixing stirrer, and maintaining the stirred material at 50 to 80° C.

In another aspect, a cosmetic container used in the method for reverse-filling the cosmetic material having irreversible property according to the present invention is provided, the cosmetic container includes:

a cosmetic outer container 10;

a cosmetic inner container 20 which is provided to be included in the cosmetic outer container 10, to the top part of which a cover 23 is hinge-coupled, and to the bottom part of which a lower stopper 25 is detachably coupled; and a filling mold 30 which is detachably coupled to the open top part of the cosmetic inner container 20 to assist the cosmetic inner container 20 such that the filling mold 30 supports the cosmetic material 2 reverse-filled from the bottom part of the cosmetic inner container 20.

In the cosmetic container used in the method for reverse-filling the cosmetic material having irreversible property according to the present invention, the filling mold 30 is characterized in that diverse patterns are formed in an engraving or embossing design on the bottom surface of the filling mold 30 detachably coupled to the open top part of the cosmetic inner container 20.

Further, in the cosmetic container used in the method for reverse-filling the cosmetic material having irreversible property according to the present invention, the cosmetic inner container 20 is characterized in that it includes an inner container body 21 having a containing space into which the cosmetic material is filled, a side portion of the inner container body 21 is composed of an inner side portion 21*a* and an outer side portion 21*b* which are radially formed along an edge of the inner container body 21 to be separated from each other, and a separation space between the inner side portion 21*a* and the outer side portion 21*b* forms a fastening groove 21*c* having an open top and a sealed bottom.

Further, the cosmetic container used in the method for reverse-filling the cosmetic material having irreversible property according to the present invention additionally includes a pad 25*a* which is formed on a bottom surface edge of the lower stopper 25 that adheres closely to a bottom surface edge of the bottom part of the inner container body 21.

Further, in the cosmetic container used in the method for reverse-filling the cosmetic material having irreversible property according to the present invention, the cover 23 includes a coupling unit 23*b* provided at a diameter position opposite to a hinge unit 23*a*, and a cover protrusion 23*c* which is formed on an inner edge of the cover 23 and fitted to a coupling groove 21*c* between the inner side portion 21*a* and the outer side portion 21*b* of the inner container body 21.

Further, in the cosmetic container used in the method for reverse-filling the cosmetic material having irreversible property according to the present invention, the coupling unit 23*b* is formed in a lever shape, and an O-ring O and a spring S are provided in a region of the coupling unit 23*b* coupled to the cover 23.

Further, in the cosmetic container used in the method for reverse-filling the cosmetic material having irreversible property according to the present invention, the cosmetic inner container 20 additionally includes a prevention member which is provided on an inner top surface of the cover 23 and a bottom surface of the lower stopper 25 such that inflow of mites or dust is prevented, and the cosmetic inner container 20 does not get damp.

Further, in the cosmetic container used in the method for reverse-filling the cosmetic material having irreversible property according to the present invention, the prevention member is a felt film formed of Evolon.

The present invention has effects that the surface of the cosmetic material filled in the cosmetic container is smooth without any bumps, moisture seepage phenomenon is prevented, and cosmetic material having excellent applicability can be provided as the hardness thereof is relatively low by reverse-filling the cosmetic container with cosmetic material having an irreversible property, such as agar, by means of a method, such as the present invention, for reverse-filling cosmetic material having an irreversible property.

Figure 6:
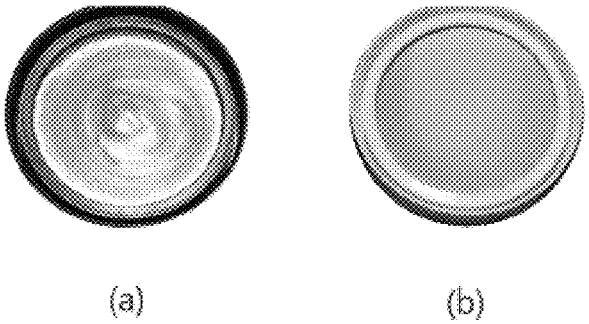
Figure 7:
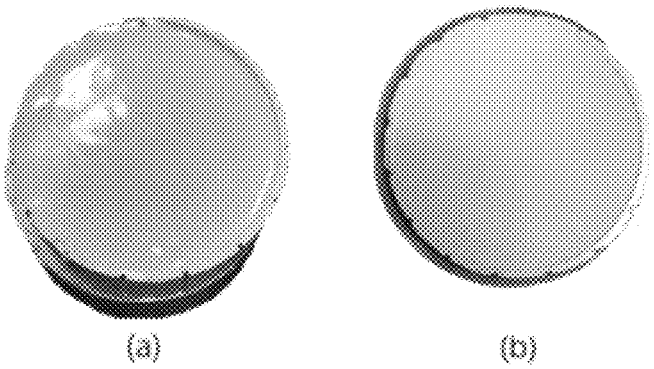

(a) and (b) of FIG. 6 and (a) and (b) of FIG. 7 are data of comparing surface treated states of cosmetic material filled by a forward-filling method and cosmetic material filled by the reverse-filling method according to the present invention.

Figure 8:
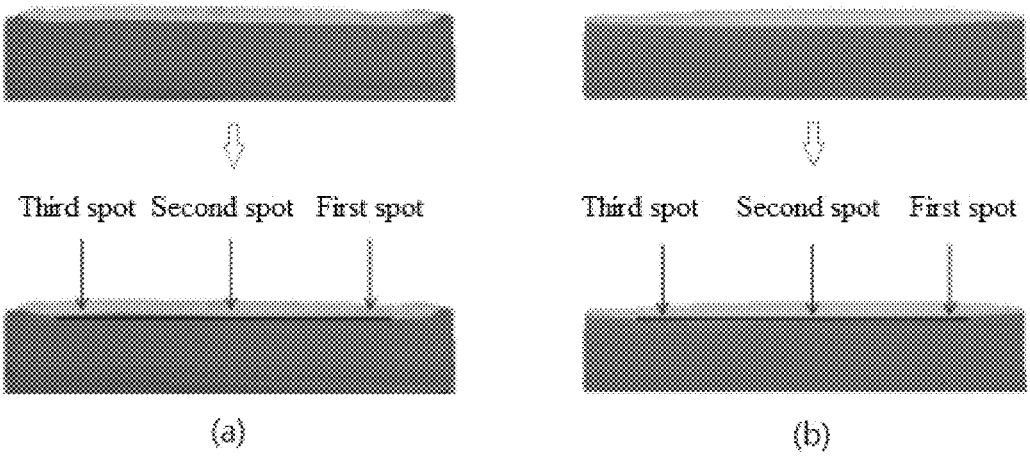

(a) and (b) of FIG. 8 are measurement position displaying data for measuring and evaluating surface uniformities of the cosmetic material filled by the forward-filling method and the cosmetic material filled by the reverse-filling method according to the present invention.

Figure 9:
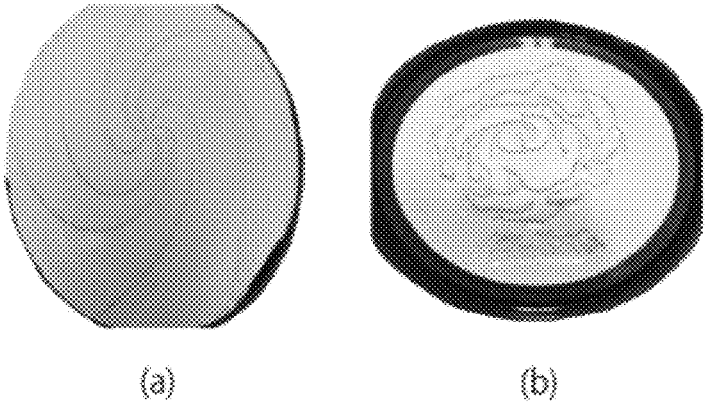

(a) and (b) of FIG. 9 are photo data illustrating patterns formed on the surface of the cosmetic material filled by the reverse-filling method according to the present invention.

DESCRIPTION OF EXEMPLARY EMBODIMENTS

Hereinafter, it will be described in more detail with reference to the drawings that a method for reverse-filling a cosmetic inner container with cosmetic material having an irreversible property according to an embodiment of the present invention is combined with the cosmetic container.

Figure 1:
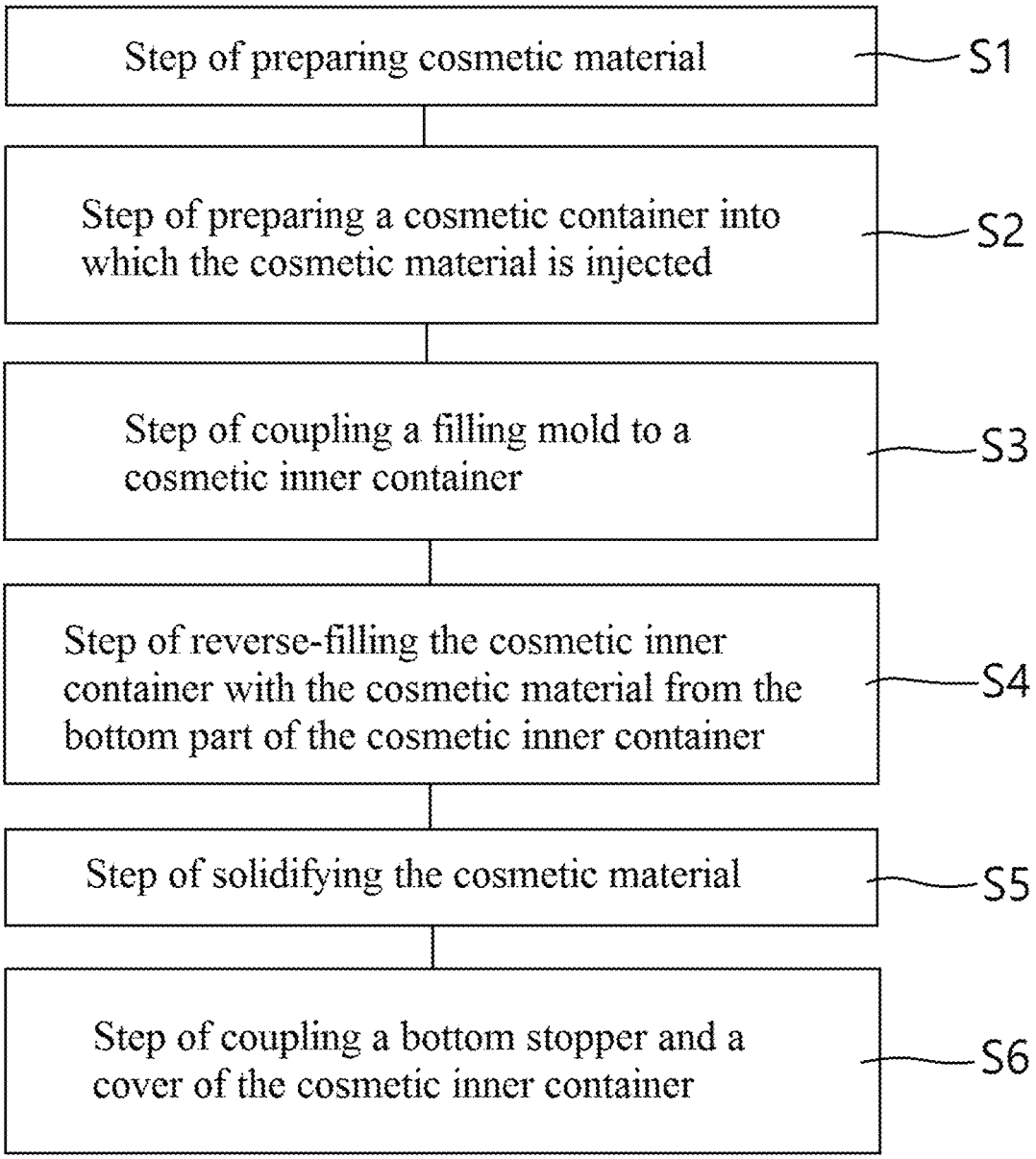
FIG. 1 is a process flow chart of a method for reverse-filling a cosmetic inner container with cosmetic material having an irreversible property according to an embodiment of the present invention.
Figure 2:
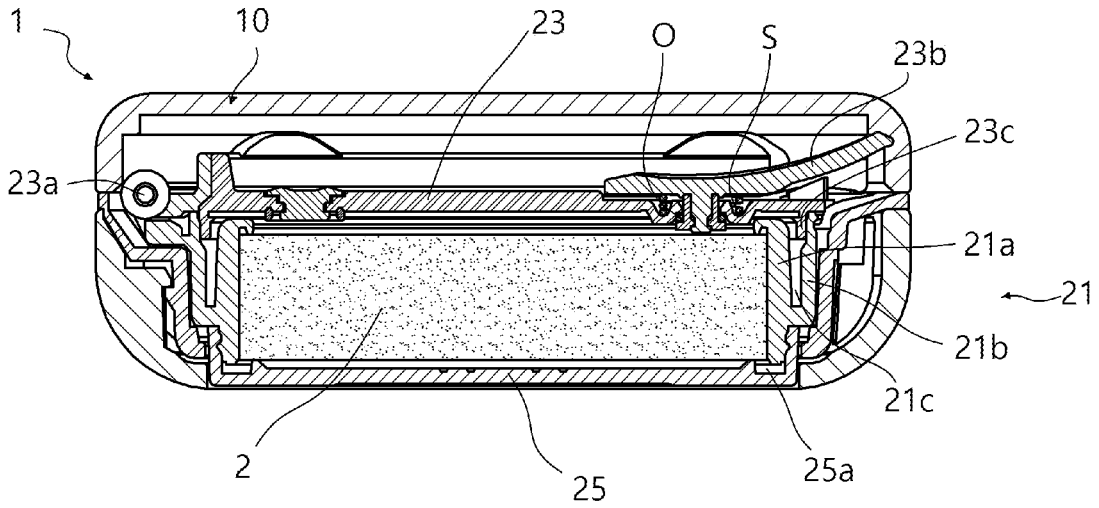
FIG. 2 is a whole cross-sectional view of a cosmetic container 1 of a state that the cosmetic container 1 is filled with cosmetic material according to an embodiment of the present invention.
Figure 3:
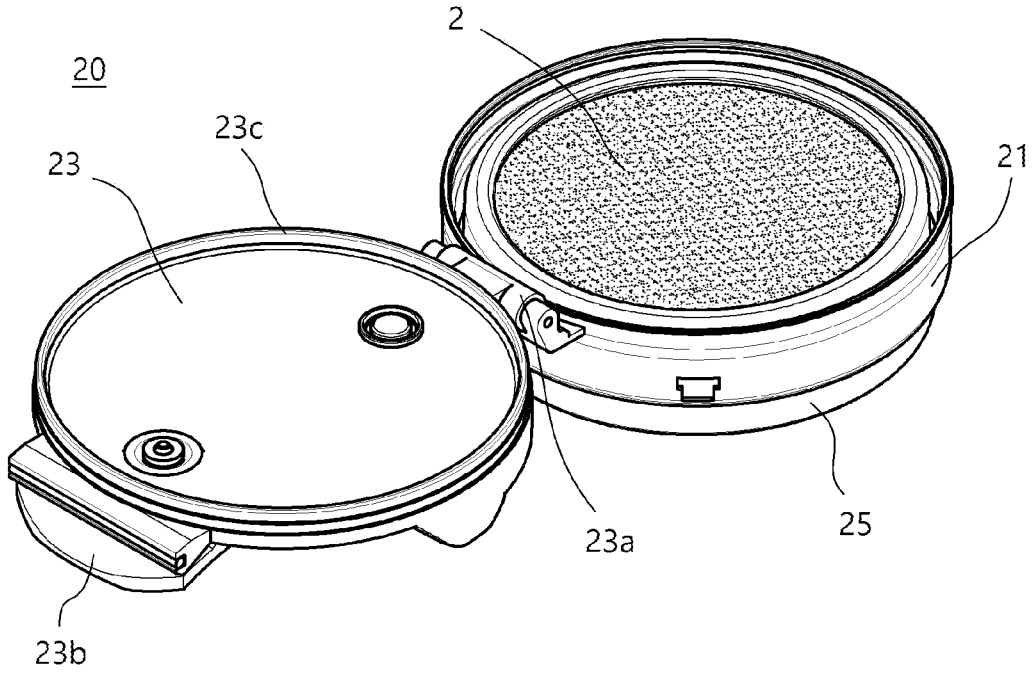
FIG. 3 is a perspective view of a state that a cover of the cosmetic inner container 20 filled with the cosmetic material 2 is open according to an embodiment of the present invention.
Figure 4:
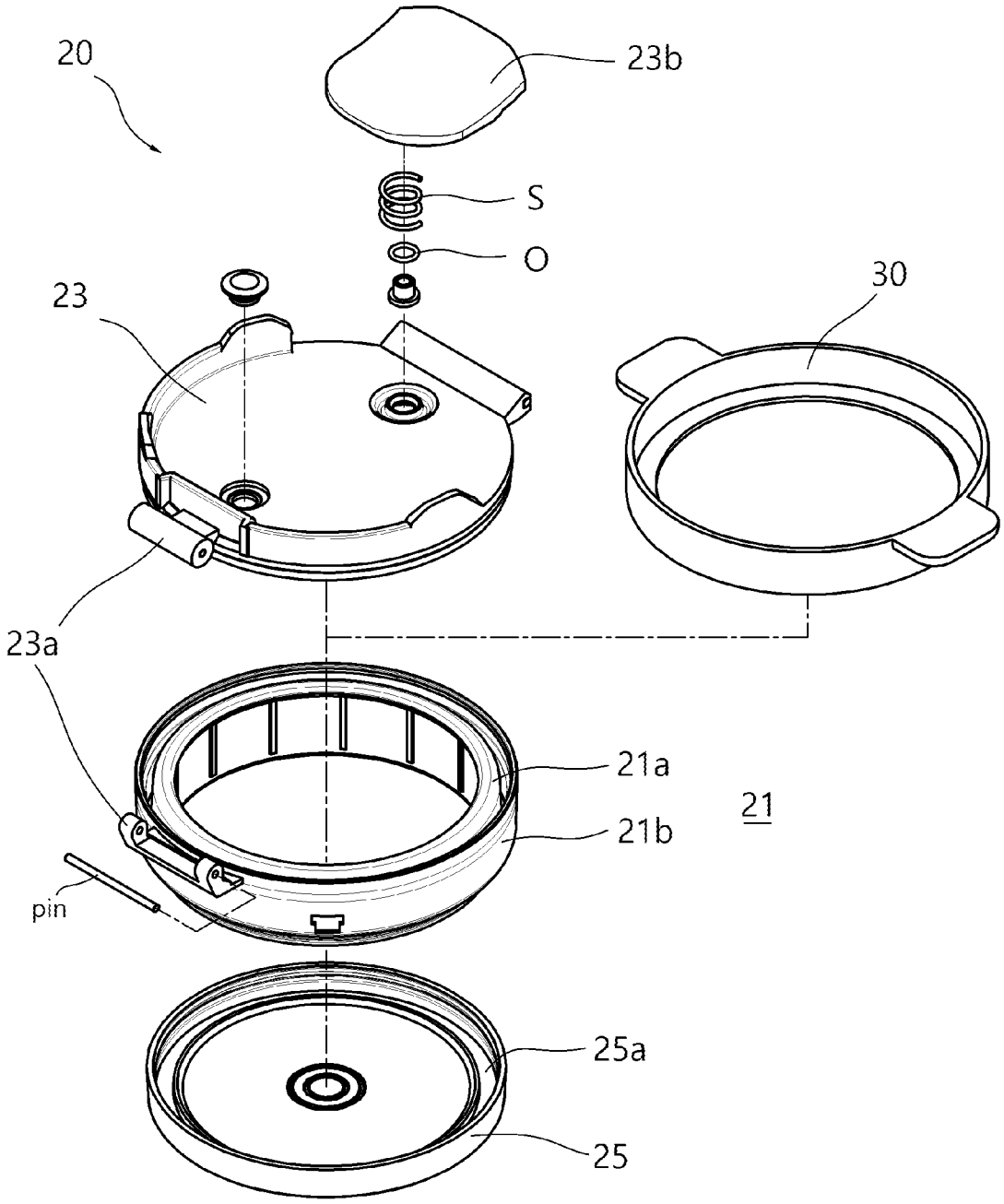
FIG. 4 is a disassembled perspective view of the cosmetic inner container and a perspective view of the filling mold used in the filling process step according to an embodiment of the present invention.
Figure 5:
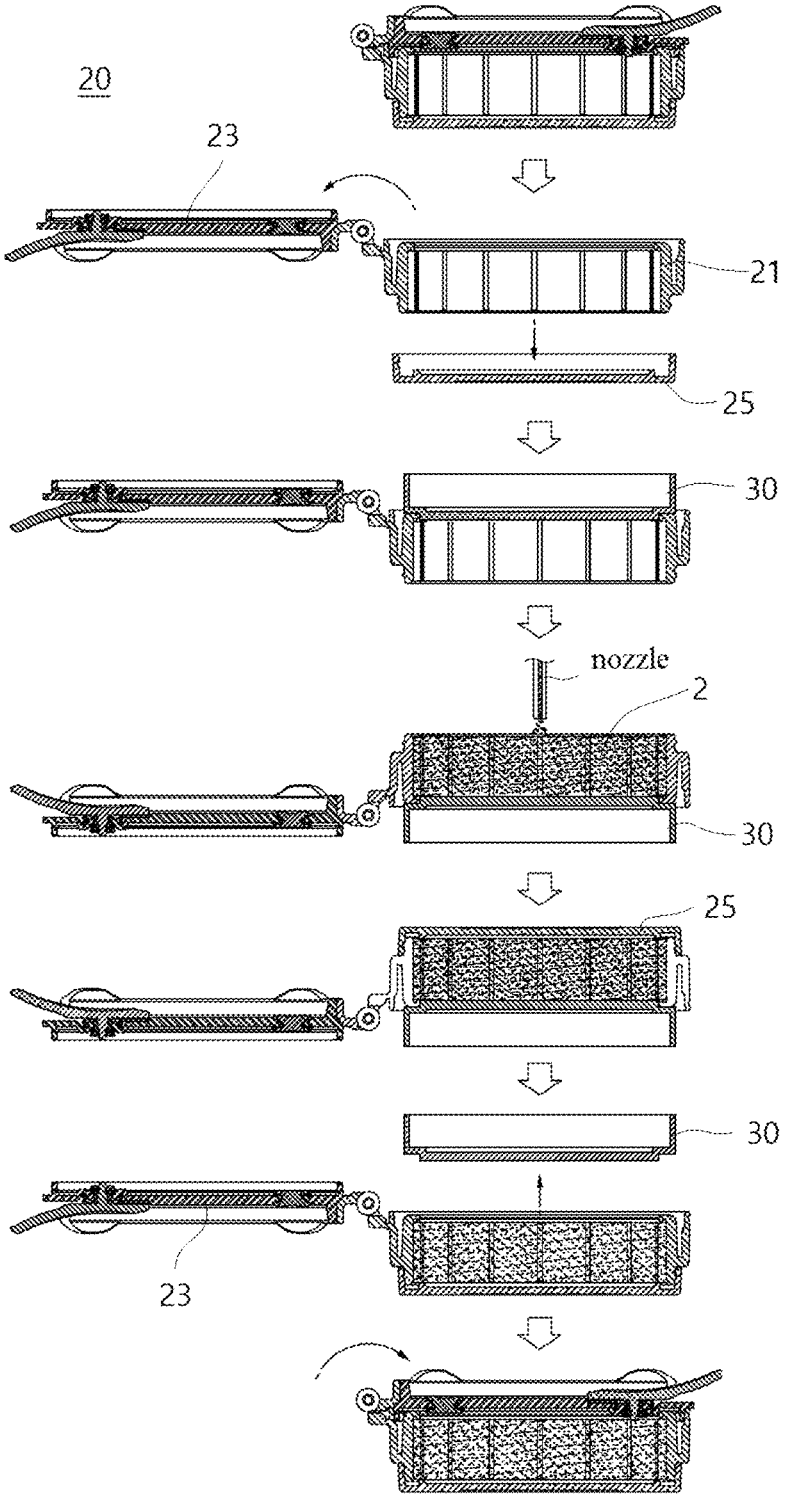
FIG. 5 is a filling flow chart illustrating that the cosmetic inner container is filled with the cosmetic material by the method for reverse-filling a cosmetic inner container with cosmetic material having an irreversible property according to an embodiment of the present invention.

The FIG. 1 is a process flow chart of a method for reverse-filling a cosmetic inner container with cosmetic material having an irreversible property according to an embodiment of the present invention, FIG. 2 is a whole cross-sectional view of a cosmetic container 1 of a state that the cosmetic container 1 is filled with cosmetic material according to an embodiment of the present invention, FIG. 3 is a perspective view of a state that a cover of the cosmetic inner container 20 filled with the cosmetic material 2 is open according to an embodiment of the present invention, FIG. 4 is a disassembled perspective view of the cosmetic inner container and a perspective view of the filling mold used in the filling process step according to an embodiment of the present invention, FIG. 5 is a filling flow chart illustrating that the cosmetic inner container is filled with the cosmetic material by the method for reverse-filling a cosmetic inner container with cosmetic material having an irreversible property according to an embodiment of the present invention, (a) and (b) of FIG. 6 and (a) and (b) of FIG. 7 are data of comparing surface treated states of cosmetic material filled by a forward-filling method and cosmetic material filled by the reverse-filling method according to the present invention, (a) and (b) of FIG. 8 are measurement position displaying data for measuring and evaluating surface uniformities of the cosmetic material filled by the forward-filling method and the cosmetic material filled by the reverse-filling method according to the present invention, and (a) and (b) of FIG. 9 are photo data illustrating patterns formed on the surface of the cosmetic material filled by the reverse-filling method according to the present invention.

A method for reverse-filling a cosmetic inner container with cosmetic material having an irreversible property according to an embodiment of the present invention is performed by a process step illustrated in FIG. 1 with reference to FIG. 5.

(S1) Step of Preparing Cosmetic Material Having an Irreversible Property

A water-soluble component of the cosmetic material is dissolved and dispersed at 30 to 80° C., agar is fully dissolved at 50 to 90° C., and the dissolved agar is mixed with the water-soluble component and dispersed in the water-soluble component to obtain a dispersion.

Further, an oil-soluble component of the cosmetic material is mixed with the dispersion to obtain a mixed solution, and the mixed solution is emulsified and dispersed at 30 to 85° C. for 3 to 10 minutes by a mixing stirrer with a rotation speed of 500 to 3800 rpm to obtain a dispersion.

After vacuum deaerating the dispersion for about 5 to 10 minutes to obtain deaerated contents, and the deaerated contents are injected into a vessel.

Next, temperature of the vessel and temperature of a nozzle are maintained at 60 to 80° C., temperature of the contents is maintained at 50 to 80° C., and cosmetic material containing an agar component is completed by enabling a mixing stirrer with a rotation speed of 200 to 1000 rpm to stir the contents while checking the bubble state of the contents.

A water-soluble component used in the cosmetic material of the present invention is an ordinary water-soluble component generally used in a cosmetic composition, and use examples of the water-soluble component is not specifically limited.

Similarly, an oil-soluble component used in the cosmetic material of the present invention is an ordinary oil-soluble component generally used in the cosmetic composition, and use examples of the oil-soluble component is not specifically limited.

(S2) Step of Preparing a Cosmetic Container into which the Cosmetic Material is Injected In order to inject prepared cosmetic material, a cosmetic outer container 10, a cosmetic inner container 20 which is provided to be contained in the cosmetic outer container, to the top part of which a cover 23 is hinge-coupled, and to the bottom part of which a lower stopper 25 is detachably coupled, and a filling mold 30 which is detachably coupled to an open top part of the cosmetic inner container 20 to assist the cosmetic inner container 20 such that the filling mold 30 supports cosmetic material 2 reverse-filled from the bottom part of the cosmetic inner container 20 are prepared as a cosmetic container 1 as illustrated in FIG. 2 to FIG. 4.

Herein, the cosmetic outer container 10 is formed to simply possess the cosmetic inner container 20 and the puff by containing the cosmetic inner container 20 and a puff (not shown), a cover is hinge-coupled to a bottom-opened body of the cosmetic outer container 10, and a coupling groove is formed in the top surface edge of the body such that a hinge unit 23*a* of the cosmetic inner container 20 is detachably inserted into the coupling hole.

The cosmetic inner container 20 includes the lower stopper 25 detachably fastened to the bottom part of the cosmetic inner container 20, an inner container body 21 in which a containing space to be filled with the cosmetic material is provided, and the cover 23 which is hinge-coupled to the top part of the inner container body 21.

A side portion of the inner container body 21 includes an inner side portion 21*a* and an outer side portion 21*b* which are radially formed along an edge of the inner container body 21 to be separated from each other, and a separation space between the inner side portion 21*a* and the outer side portion 21*b* forms a fastening groove 21*c* having an open top and a sealed bottom.

Further, the cosmetic container 1 may additionally include a pad 25*a* which is formed on the bottom surface edge of the lower stopper 25 that adheres closely to the bottom surface edge of the bottom part of the inner container body 21 such that the pad 25*a* can prevent leakage of the cosmetic material from a fastening region of the inner container body 21 and the lower stopper 25.

The cover includes a coupling unit 23*b* provided at the diameter position opposite to the hinge unit 23*a* to facilitate coupling and decoupling of the cover from the inner container, and a cover protrusion 23*c* which is formed on the inner edge of the cover 23 and fitted to the coupling groove 21*c* between the inner side portion 21*a* and the outer side portion 21*b* of the inner container body 21.

Herein, the coupling unit 23*b* is formed in a lever shape to facilitate coupling and decoupling of the cover by the coupling unit 23*b*, i.e., opening and closing of the cover by the coupling unit 23*b*, and the coupling unit 23*b* preferably includes an O-ring O and a spring S which are provided in a region of the coupling unit 23*b* coupled to the cover. The cover is decoupled from the inner container by an operation of pulling a front end of the coupling unit in an upward direction, and is coupled to the inner container by an operation of pressing a rear end of the coupling unit.

Further, the cosmetic container may additionally include a felt film (not shown) as a prevention member which is formed on the inner top surface of the cover 23 and the bottom surface of the lower stopper 25 such that inflow of mites or dust is prevented, and the cosmetic container does not get damp. At this time, any materials as the materials for the felt film are not limited if materials for the felt film are excellent in allergy prevention and have excellent air permeability and wettability. The felt film is preferably formed of Evolon.

Further, the filling mold 30 is detachably coupled to the open top part of the cosmetic inner container 20 in the process of reverse-filling the cosmetic material, and diverse patterns may be formed in an engraving or embossing design on the bottom surface of the filling mold 30.

Since shape of the top surface of cosmetic material completed according to shape of the bottom surface of the filling mold is determined, it is preferable that the bottom surface of the filling mold is flatly formed to obtain surface uniformity of the top surface of the cosmetic material. Herein, it goes without saying, of course, that a central portion of the bottom surface of the filling mold may be formed in a slightly convex shape to facilitate separation of the filling mold from the cosmetic material when the filling mold is removed.

Further, since the diverse patterns formed on the bottom surface of the filling mold are transferred onto the top surface of the completed cosmetic material as illustrated in FIG. 9 such that the diverse patterns are formed in an embossing or engraving design, the filling mold not only enables elaborate and diverse patterns to be expressed, but also enables visual beauty to be felt even without performing a separate process.

Although the present invention illustrates a filling mold made of a member of which a bottom surface is formed in a shape fitted to the top part of the cosmetic inner container such that the filling mold may be detachably coupled to the open top part of the cosmetic inner container 20 as the filling mold 30 which assists the cosmetic inner container 20 to support the cosmetic material 2 reverse-filled from the bottom part of the cosmetic inner container 20, the filling mold 30 is not limited to this, and the filling mold 30 is preferably formed in the form of a sealing paper (not shown) formed of materials such as aluminum and the like for sealing the top part of the cosmetic inner container. Herein, the sealing paper may support and assist the cosmetic material 2 reverse-filled from the bottom part of the cosmetic inner container 20 by performing a high frequency sealing process on the open top part of the cosmetic inner container 20. Patterns may also be formed in an embossing or engraving design on the bottom surface of the sealing paper.

(S3) Step of Coupling the Filling Mold 30 to the Top Part of the Cosmetic Inner Container 20

To reverse-fill the cosmetic inner container 20 with prepared cosmetic material 2, after separating the cosmetic inner container 20 from the cosmetic outer container 10, top and bottom of the cosmetic inner container 20 are opened by opening the cover 23 of the cosmetic inner container 20 and opening the lower stopper 25 coupled to the bottom part of the cosmetic inner container 20. After that, the filling mold 30 is coupled to an open top part of the cosmetic inner container 20 to seal the open top part thereof.

(S4) Step of Reverse-Filling the Cosmetic Material 2 from the Bottom Part of the Cosmetic Inner Container 20

After turning the cosmetic inner container 20 having its top part sealed by the filling mold 30 upside down to reverse-position the cosmetic inner container 20 so that the sealed top part of the cosmetic inner container 20 is directed downward and the open bottom part thereof is directed upward, and a containing space within the cosmetic inner container 20 is filled with the cosmetic material through the bottom part thereof using a nozzle. Herein, temperature of the vessel and temperature of the nozzle are maintained at 60 to 80° C., temperature of the cosmetic material within the vessel is maintained at 50 to 80° C.

(S5) Step of Solidifying the Cosmetic Material 2

The cosmetic material 2 filled through the bottom part of the cosmetic inner container 20 is solidified by cooling the cosmetic material 2 at a temperature of −20 to 4° C. for about 3 to 10 minutes and solidifying the cosmetic material 2 at room temperature for about 10 to 30 minutes in a state that a separate surface treatment process has not been performed on the cosmetic material 2.

At this time, it is preferable that 0.001 to 0.02 g (wt %) of water oozes out from the cosmetic material based on the total weight of the cosmetic material in the solidification step. If more than 0.02 g of water oozes out from the cosmetic material in the solidification step, the amount of water contained in the cosmetic material is relatively decreased. Therefore, hardness of the cosmetic material is increased, elasticity of the cosmetic material is insufficient, and moisturizing activity of the cosmetic material is deteriorated.

(S6) Step of Fastening the Lower Stopper and the Cover of the Cosmetic Inner Container 20

When it is checked that the cosmetic material 2 is formed in a solidified formulation by cooling the cosmetic material 2 within the cosmetic inner container 20, the lower stopper 25 is coupled to the bottom part of the cosmetic inner container 20 to close the cosmetic inner container 20, the cosmetic inner container 20 is forward-positioned such that the top part of the cosmetic inner container 20 is directed upward, and the filling mold 30 in the top part of the cosmetic inner container 20 is removed. After that, the cover 23 of the cosmetic inner container 20 is closed.

Herein, as a result of measuring a sectional height at each point on the top surface of completed cosmetic material, it was measured that a maximum surface step is included in a range of about 0.1 to 0.4 mm that is a relatively small value. In addition, as a maximum surface step width at each measurement test is also in a range of about 0.1 to 0.4 mm, it was checked that almost equal results can be obtained.

Hereinafter, the present invention will be further described by combining specific embodiments. Such embodiments are just examples describing the present invention and do not limit the scope of the present invention. Experiment methods which do not write specific conditions in the following examples are proceeded according to usual conditions or conditions offered in the manufacturing aspect. Except for cases including special descriptions, all number of parts are parts by weight, and all percentages are percentages by weight.

Example 1

1-1. Measurement and Evaluation of Moisture Seepage Properties of Cosmetic Material Containing Agar Filled by Reverse-Filling Method In order to measure and evaluate water seepage properties of the cosmetic material prepared by a reverse-filling method according to an embodiment of the present invention, degrees that the parchment paper were smeared and absorbed with water were measured when Example and Comparative Example were taken on parchment paper by a method of reverse-filling and forward-filling the cosmetic material at a temperature of 50 to 70° C., cooling the reverse-filled and forward-filled cosmetic material at −20 to 4° C. for 3 to 10 minutes, and thawing the cooled cosmetic material at room temperature for 10 to 30 minutes.

As can be confirmed from results of [Table 1], water seepage phenomena of oozing out water were severely shown in case of Comparative Example including a forward-filling process performed in the cosmetic material solidification step. On the other hand, water seepage phenomena seen with the naked eye were rarely existed in case of Example including a reverse-filling process performed according to the present invention.

TABLE 1

| | Example | Comparative Example |
|---|---|---|
| Experiment 1 | 0.003 g | 0.030 g |
| Experiment 2 | 0.007 g | 0.031 g |

TABLE 1-continued

| | Example | Comparative Example |
|---|---|---|
| Experiment 3 | 0.005 g | 0.033 g |
| Average | 0.005 g | 0.031 g |

Example 2

2-1. Surface Treatment Evaluation of Cosmetic Material Containing Agar Filled by Reverse-Filling Method To evaluate surface treatment of cosmetic material prepared by filling the cosmetic material by the reverse-filling method according to an embodiment of the present invention, comparative pictures of Example and Comparative Example of the [Table 1] are shown in (a) and (b) of FIG. 6 and (a) and (b) of FIG. 7.

As shown in (a) and (b) of FIG. 6, it can be confirmed that cosmetic material of Comparative Example (a) filled by the forward-filling process has a pearl band formed on the surface thereof and has the surface that is not smooth, while cosmetic material of Example (b) filled by the reverse-filling process according to the present invention has the surface that is clean, consistent and smooth without any curve.

Further, as shown in (a) and (b) of FIG. 7, it can be confirmed that the cosmetic material of Comparative Example (a) filled by the forward-filling process has its side portion of the formulation easily collapsed, while the cosmetic material of Example (b) filled by the reverse-filling process according to the present invention has its formulation formed in a predetermined shape.

2-2. Surface Uniformity Measurement and Evaluation of Cosmetic Material Containing Agar Filled by Reverse-Filling Method In order to measure and evaluate surface uniformity of the cosmetic material prepared by filling the cosmetic material by the reverse-filling method according to an embodiment of the present invention, cross sections at spot positions shown in (a) and (b) of FIG. 8 of formulated cosmetic materials of Examples and Comparative Examples were cut, and height of the cut cross section of the formulated cosmetic material was measured by vernier calipers at each spot of the formulated cosmetic material.

As can be confirmed from results of [Table 2], the cosmetic material of Comparative Example (a) prepared by filling the cosmetic material by the forward-filling process of Comparative Examples has a relatively large height difference at each spot and resultingly has a maximum surface step value of 0.44 mm, 0.55 mm, 1.46 mm or 1.63 mm, while cosmetic material of Example (b) prepared by filling the cosmetic material by the reverse-filling process according to the present invention has a small height difference at each spot and has a measured maximum step value of 0.10 mm, 0.14 mm, 0.18 mm or 0.27 mm As known from the above results, it has been shown that filling of the cosmetic material by the forward-filling process not only has a large maximum step value, but also has a large maximum step width of measurement experiment, while filling of the cosmetic material by the reverse-filling process not only has a relatively small maximum step value, but also has a small maximum step width of measurement experiment.

This means that cosmetic materials of Comparative Examples have lower surface uniformity values than cosmetic materials of Examples.

TABLE 2

| | Examples | | | |
|---|---|---|---|---|
| | First Example | Second Example | Third Example | Fourth Example |
| First spot | 10.15 mm | 10.25 mm | 9.33 mm | 9.40 mm |
| Second spot | 10.03 mm | 9.98 mm | 9.31 mm | 9.22 mm |
| Third spot | 10.17 mm | 10.06 mm | 9.21 mm | 9.53 mm |
| Maximum step value | 0.14 mm | 0.27 mm | 0.10 mm | 0.18 mm |
| | Comparative Examples | | | |
| | First Comparative Example | Second Comparative Example | Third Comparative Example | Fourth Comparative Example |
| First spot | 10.14 mm | 9.95 mm | 9.78 mm | 9.28 mm |
| Second spot | 9.94 mm | 10.26 mm | 10.72 mm | 10.89 mm |
| Third spot | 9.70 mm | 9.71 mm | 9.26 mm | 10.91 mm |
| Maximum step value | 0.44 mm | 0.55 mm | 1.46 mm | 1.63 mm |

Example 3

3-1. Hardness Evaluation of Cosmetic Material Containing Agar Filled by Reverse-Filling Method To evaluate pay-off of cosmetic material prepared by filling the cosmetic material by the reverse-filling method according to an embodiment of the present invention, hardness values (dyne/cm$^3$) of both sides and surface of formulated cosmetic materials of Example and Comparative Example were measured.

As can be confirmed from results of [Table 3], it can be seen that cosmetic material prepared by filling the cosmetic material by a forward-filling process of Comparative Example has high hardness values, while cosmetic material of Example prepared by filling the cosmetic material by a reverse-filling process according to the present invention has relatively low hardness values. This means that the cosmetic material of Example has more excellent applicability than the cosmetic material of Comparative Example due to a puff of the cosmetic material of Example.

TABLE 3

| | Example | Comparative Example |
|---|---|---|
| Side 1 | 150 | 186 |
| Side 2 | 160 | 185 |
| Surface | 159 | 180 |

Further, FIG. 9, as photo data illustrating patterns formed on the surface of the cosmetic material filled by the reverse-filling method according to the present invention, elaborate and diverse patterns are expressed on the top surface of the cosmetic material as illustrated in (a) and (b), thereby giving an esthetic sense to a user. The cosmetic material is prepared by filling the cosmetic material by the reverse-filling method, i.e., the cosmetic material is prepared such that elaborate and diverse patterns formed on the bottom surface of the filling mold are expressed on the top surface of the cosmetic material as they are when the cosmetic inner container is positioned in a forward direction after reverse-filling the cosmetic material.

Although the present method has been described in relation to the above-described preferred embodiments, different diverse modifications or variations of the preferred embodiments will be possible without deviation of gist and scope of the present invention. The preferred embodiments should be considered in a descriptive sense only and not for purposes of limitation. Therefore, the scope of the present invention is defined not by the above-mentioned detailed description but by the appended claims, and all differences within the scope will be construed as being included in the present invention.

What is claimed is:

1. A method for reverse-filling the cosmetic material having irreversible property, as a method for filling a cosmetic inner container with cosmetic material having an irreversible property, comprising the steps of:

sealing the top part of the cosmetic inner container, the top and bottom of which are open, with a filling mold, and turning the cosmetic inner container upside down to reverse-position the cosmetic inner container so that the sealed top part of the cosmetic inner container is directed downward and the open bottom part thereof is directed upward; and filling the cosmetic inner container through the bottom part thereof with the cosmetic material, wherein the bottom surface of the filling mold is flatly formed so that the top surface of the cosmetic material filled in the cosmetic inner container obtain a surface uniformity of maximum surface step of 0.1 to 0.4 mm, further comprising, after the step of filling the cosmetic material, a step of cooling the filled cosmetic material to solidify the cosmetic material, wherein the cosmetic material is cooled at a temperature of −20 to 4° C. for 3 to 10 minutes and solidified at room temperature for 10 to 30 minutes.

2. The method of claim 1, wherein, in the step of solidifying the cosmetic material, water oozes out from the cosmetic material in an amount of 0.001 to 0.02 g (wt %) based on the total weight of the cosmetic material.

3. The method of claim 1, further comprising, after the step of solidifying the cosmetic material, a step of coupling a lower stopper to the bottom part of the cosmetic inner container, forward-positioning the cosmetic inner container such that the bottom part of the cosmetic inner container is directed downward, and removing a filling mold sealed on the top part of the cosmetic inner container.

4. The method of claim 1, wherein the filling mold is a member having a shape that the bottom surface of the filling mold is fitted to the top part of the cosmetic inner container.

5. The method of claim 4, wherein the bottom surface of the member have a pattern formed in an embossing or engraving design thereon.

6. The method of claim 5, wherein a pattern of the bottom surface of the filling mold is transferred onto the top surface of the cosmetic material filled in the cosmetic inner container such that the pattern is formed in an engraving or embossing design.

7. A method for reverse-filling cosmetic material having irreversible property, the method comprising the steps of:

preparing the cosmetic material having irreversible property;

preparing a cosmetic container into which the cosmetic material is injected;

coupling a filling mold to the top part of a cosmetic inner container, the top and bottom of which are open, in the cosmetic container;

reverse-positioning the cosmetic inner container and reverse-filling the cosmetic inner container with the cosmetic material from the open bottom part of the cosmetic inner container;

solidifying the cosmetic material; and coupling a bottom stopper and a cover of the cosmetic inner container, wherein the bottom surface of the filling mold is flatly formed so that the top surface of the cosmetic material filled in the cosmetic inner container obtain a surface uniformity of maximum surface step of 0.1 to 0.4 mm, wherein the cosmetic material having irreversible property filled in the cosmetic inner container is prepared by dissolving and dispersing a water-soluble component of the cosmetic material at 30 to 80° C., completely dissolving agar at 50 to 90° C., and mixing and dispersing the completely dissolved agar with the water-soluble component to prepare a dispersion, mixing an oil-soluble component of the cosmetic material with the dispersion, emulsifying and dispersing a mixed solution of the oil-soluble component and the dispersion by a mixing stirrer at 30 to 85° C. for 3 to 10 minutes, and deaerating the emulsified and dispersed solution for about 5 to 10 minutes, and then injecting the emulsified and dispersed solution into a vessel which is maintained at a predetermined temperature, stirring the emulsified and dispersed solution by the mixing stirrer, and maintaining the stirred material at 50 to 80° C.

8. A cosmetic container used in the method for reverse-filling the cosmetic material having irreversible property of claim 7, the cosmetic container including:

a cosmetic outer container;

a cosmetic inner container which is provided to be included in the cosmetic outer container, to the top part of which a cover is hinge-coupled, and to the bottom part of which a lower stopper is detachably coupled; and a filling mold which is detachably coupled to the open top part of the cosmetic inner container to assist the cosmetic inner container such that the filling mold supports the cosmetic material reverse-filled from the bottom part of the cosmetic inner container, wherein the bottom surface of the filling mold is flatly formed so that the top surface of the cosmetic material filled in the cosmetic inner container obtain a surface uniformity of maximum surface step of 0.1 to 0.4 mm, wherein the cosmetic inner container includes an inner container body having a containing space into which the cosmetic material is filled, a side portion of the inner container body is composed of an inner side portion and an outer side portion which are radially formed along an edge of the inner container body to be separated from each other, and a separation space between the inner side portion and the outer side portion forms a fastening groove having an open top and a sealed bottom.

9. The cosmetic container of claim 8, wherein the filling mold has diverse patterns formed in an engraving or embossing design on the bottom surface thereof, and is detachably coupled to the open top part of the cosmetic inner container.

10. The cosmetic container of claim 8, additionally including a pad which is formed on a bottom surface edge of the lower stopper that adheres closely to a bottom surface edge of the bottom part of the inner container body.

11. The cosmetic container of claim 8, wherein the cover includes a coupling unit provided at a diameter position opposite to a hinge unit, and a cover protrusion which is formed on an inner edge of the cover 23 and fitted to a coupling groove between the inner side portion and the outer side portion of the inner container body.

12. The cosmetic container of claim 11, wherein the coupling unit is formed in a lever shape, and an O-ring and a spring are provided in a region of the coupling unit coupled to the cover.

* * * * *